US006197113B1

(12) United States Patent
Zimmer

(10) Patent No.: US 6,197,113 B1
(45) Date of Patent: Mar. 6, 2001

(54) DEVICE FOR APPLYING LIQUIDS ON A SUBSTRATE

(76) Inventor: Johannes Zimmer, Ebentaler Str. 133, 9020, Klagenfurt (AT)

( * ) Notice: Subject to any disclaimer, the term of this patent is extended or adjusted under 35 U.S.C. 154(b) by 0 days.

(21) Appl. No.: 09/150,930

(22) Filed: Sep. 10, 1998

(30) Foreign Application Priority Data

Sep. 11, 1997 (DE) ..... 297 16 541 U

(51) Int. Cl.[7] ..... B05C 1/08

(52) U.S. Cl. ..... 118/249; 118/250; 118/251; 118/256

(58) Field of Search ..... 118/249, 250, 118/251, 409, 416, 429, 256; 100/160, 168; 427/428

(56) References Cited

U.S. PATENT DOCUMENTS

| | | | | |
|---|---|---|---|---|
| 4,073,263 | * | 2/1978 | Melton | 118/247 |
| 4,091,129 | * | 5/1978 | Schaeuble | 118/249 |
| 4,165,688 | | 8/1979 | Leanna et al. . | |
| 4,998,500 | * | 3/1991 | Zimmer | 118/110 |
| 5,253,495 | * | 10/1993 | Zimmer | 68/43 |
| 5,302,203 | * | 4/1994 | Zimmer | 118/117 |

FOREIGN PATENT DOCUMENTS

| | | |
|---|---|---|
| 40 16 662 | 11/1990 | (DE) . |
| 295 17 095 U | 4/1996 | (DE) . |
| WO85/01226 | 3/1985 | (WO) . |
| WO96/37312 | 11/1996 | (WO) . |

* cited by examiner

*Primary Examiner*—Laura Edwards
(74) *Attorney, Agent, or Firm*—Mattingly, Stanger, Malur, P.C.

(57) ABSTRACT

The invention is a device for the application of determinable quantities particularly of viscous liquids onto a movable substrate, consisting of an application roller that spans the length of the device, a supply mechanism to provide the liquid to the application roller, a contact press that pushes the application roller against the substrate, which, when pressed between the application roller and the substrate, creates a narrowing intake gusset in the direction of movement (D) of the application roller and at least one demarcation element that acts in combination with the application roller to define the width of application of the liquid (application width) being applied to the substrate.

17 Claims, 4 Drawing Sheets

DEVICE FOR APPLYING LIQUIDS ON A SUBSTRATE

FIELD OF THE INVENTION

The invention is a device for the application of determinable quantities particularly of viscous liquids onto a movable substrate, consisting of an application roller that spans the length of the device, a supply mechanism to provide the liquid to the application roller, a contact press that pushes the application roller against the substrate, which, when pressed between the application roller and the substrate, creates a narrowing intake gusset in the direction of movement (D) of the application roller and at least one demarcation element that acts in combination with the application roller to define the width of application of the liquid (application width) being applied to the substrate.

DESCRIPTION OF RELATED ART

DE 295 17 095.6 describes a device with packing blocks that flank a tub containing the liquid (substance) on the frontal side and that are configured to slide along the long side of the device so that the width of application can be adjusted. The blocks consist of packing material, such as felt. By means of this packing material, the blocks make contact with a dispensing roller that forms the application roller as well as with a counterbalancing cylinder. This packing contact device must be configured in such a way that the liquid to be applied is held leak-free inside the holding tub, particularly while the device is stopped. A substance film forms on the counterbalancing cylinder; this film is applied to a foil on the vertex area of the counterbalancing cylinder. If the substance film being transported on the cylinder is relatively thick and/or the substance features a relatively high viscosity, a bulge-like thickening develops on the borders of the application width. Even if such thickening along the borders is low, for example amounting only to 1/100 mm, a foil roll of several hundred layers would have a bothersome and unacceptable bulge. For relatively thick foil layers, the bulges on the edges would become so large that they would lead to application edges that are not clean or sharp; this, in turn, would lead to smearing and spreading of such impurities when the layering substance dries out partially or completely. Such an event, in turn, would make it more difficult to keep the device unclogged and operating smoothly. In order to significantly limit the layering edges that span the length of the foil, DE 295 17 095.6 provides for a scraper on the dispensing roller with a scraping blade such as a slat strip, and additionally limits the dispensing film edges by means of a stream of compressed air. Even such effort-consuming additional measures limit the coating thickness significantly. Additionally, regular scrapers with rolling scrapers or spread scrapers are known from WO 85/01226, for example.

SUMMARY OF THE INVENTION

It is the objective of this invention to improve the quality of application such that each application edge along the direction of movement of the substrate is created free of bulges and cleanly with precise edge demarcation, particularly in the fabrication of laminates, such as in the lacquering of foils.

This objective is achieved in a combination, where the demarcation element consists of a casing that covers the application roller along a section of the length of the roller and over a portion of its circumference with identical shape and diameter, while preserving its rotating capability, whereby the part of the section of the length of the roller forms a segment which is transverse to the direction of movement of the substrate, causing a liquid intake in that transverse direction. This invention shows that the intake section that stretches parallel to the application roller creates a hydrodynamically-induced cross current of substance in the area of the intake gusset. In this way, the substance is drawn along the borders into the liquid intake section in the longitudinal direction of the application roller, that means, perpendicular to the direction of rotation of the roller or cylinder. This cross current is so insignificant, when coordinated with the surface structure of the application roller (dispensing roller), that the application edge turns into a narrow, bulge-free run-off on the substrate, which is demarcated by an essentially straight line. With the cross flow section, a defined and cleanly delimited edge can be fabricated that remains free of layering, particularly on each long side of a foil roll piece, which can also be very narrow, because, as a result of the bulge-free run-off edge, edge impurities can be reliably avoided even on relatively thick coatings. By this invention, the demarcation casing can be easily attached to the application roller, whereby special measures that are conventionally designed for the packing contact system by means of a packing block on the application roller, a substrate and/or a counter device, will not be necessary. The dispensing, bulge-free application of substances achieved through this invention can be done directly onto a foil roll. Instead, the bulge-free application of substance to an application cylinder can also be provided for. Within the framework of this invention, the surfaces onto which the substance is applied are defined as substrates.

In the preferred configuration, the section of the application roller surrounded by the casing is open only where the roller touches the substrate. Thus, the casing appropriately surrounds about 2/3 to 4/5 of the application roller's circumference. Because the casing covers the largest portion of the circumference of the application roller, it was determined that not only is a clearly defined run-off edge guaranteed even if operation parameters are modified, but the casing can conveniently be positioned onto the application roller, which precludes its loss.

A particularly convenient configuration of the invention consists in arranging the application roller in a dipping tub that constitutes a supply mechanism, and to place the casing together with the application roller in the dipping tub, so that it can move perpendicular against the substrate surface.

It is particularly advantageous to place the dipping tub totally underneath the substrate. Particularly in relation with the aforementioned snap connection, where the application roller is exposed only in the area of the counterbalancing system, the circumference area of the application roller which dips into the substance contained in the dipping tub, including the area of its circumference that transports the substance upwards, is surrounded by the delimiting casing.

In a particularly preferred configuration, the device of this invention contains a magnetic contact press, whereby the substrate is placed on a magnetic beam and the application roller can be magnetically charged to press it against the substrate, and where the casing is permanently connected to the application roller. In combination with the magnetic press, the casing can be attached particularly easily. At the same time, it is made most usefully of a non-magnetizable material such as brass or something similar, so that it does not itself contribute to the pressing force but rather only moves along with the application roller, where the previously defined separate crosscurrent generates a precise run-off edge in a particularly easy and effective way.

In one configuration, the casing can be advantageously placed by means of a bearing which slides in a direction parallel to the pressing direction of the application roller.

In another advantageous configuration of the invention, the casing swivels least slightly around the axis of the application roller by means of the latter.

Subsidiary claims are oriented towards other effective as well as advantageous configurations of the invention, and particularly effective and advantageous implementation designs or possibilities for the invention are described in more detail in the following descriptions of the design examples illustrated in the schematic drawings.

DETAILED DESCRIPTION OF THE DRAWINGS

Figure 1:
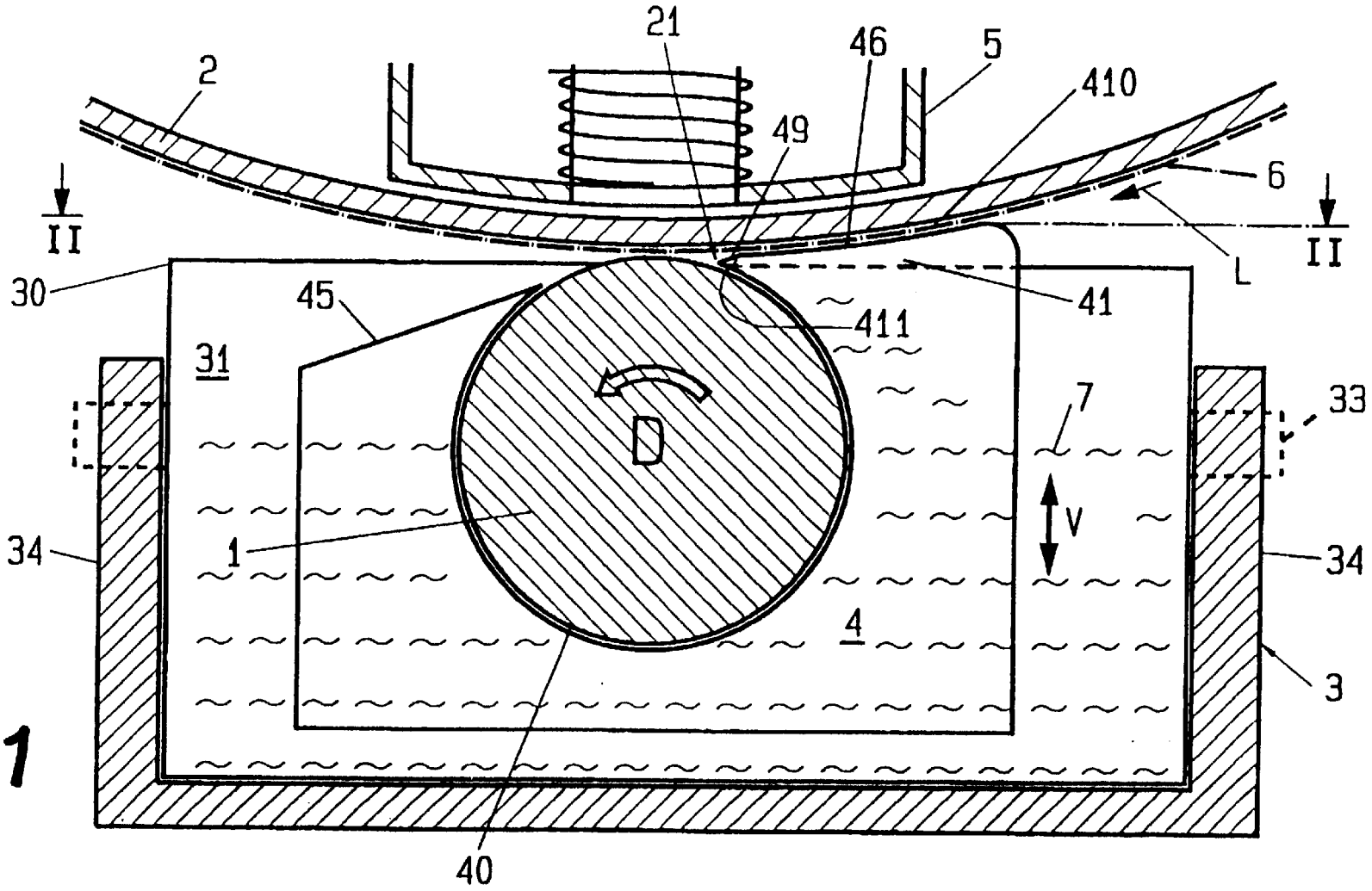
FIG. 1 shows a partial profile cross section of a device according to the invention with a magnetic press and a dipping tub placed totally under a counterbalanced cylinder system.
Figure 2:
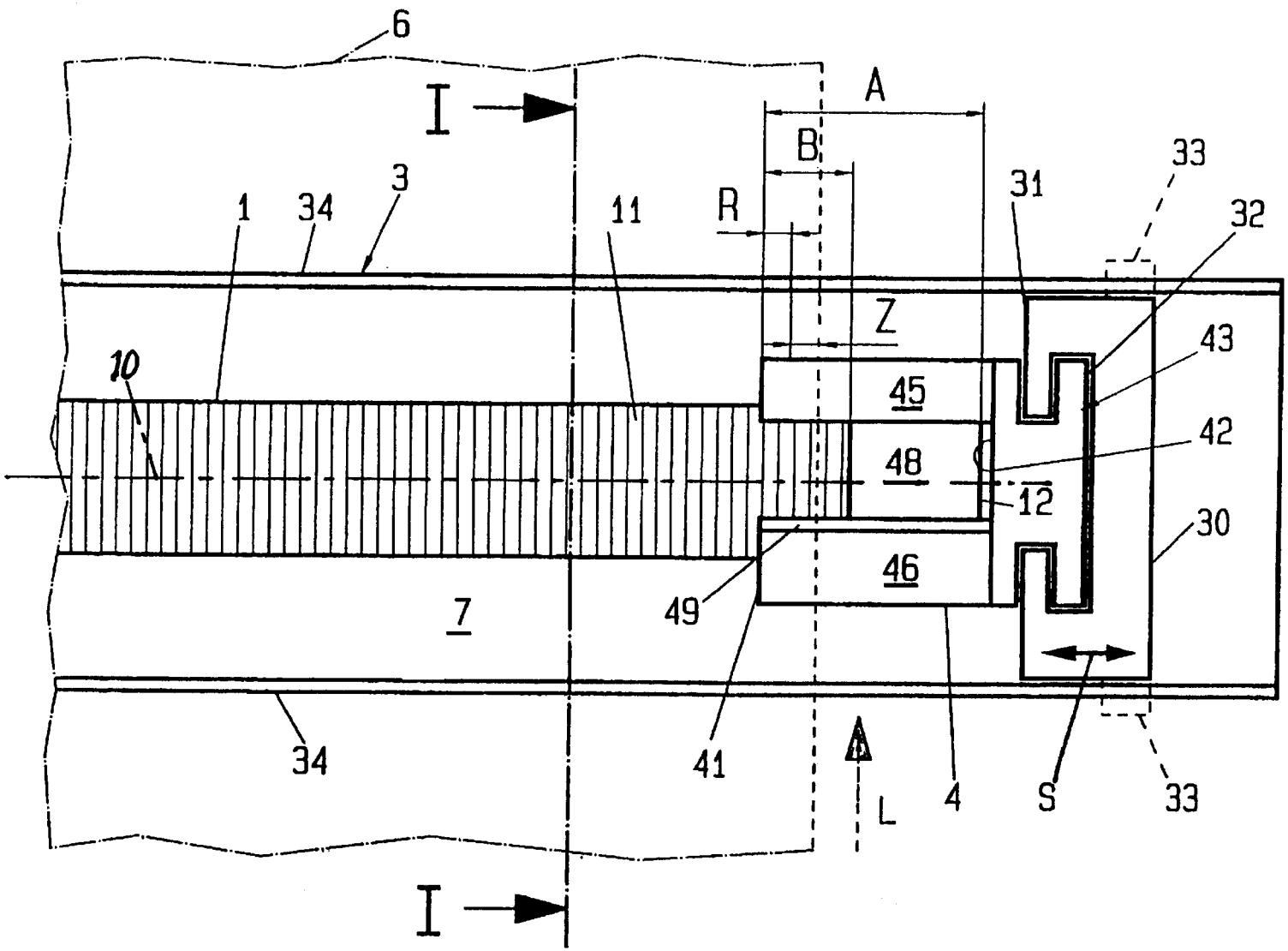
FIG. 2 shows a partial top view according to II—II in FIG. 1 of the dipping tub with the parts contained therein

FIGS. 1 and 2 show a device in accordance with the invention with its essential construction pieces in partial view. The device comprises an application cylinder in the shape of a dispensing cylinder 1, a counter cylinder system 2 that spans the longitudinal direction of the device, a dipping tub 3 placed totally under cylinder 2, where dispensing roller 1 dips partially into substance 7 contained in dipping tub 3, on which demarcation casing 4 is attached to both ends of dispensing roller 1 and which dips partially into substance 7, as well as a magnetic device 5 placed within cylinder 2 and stretching lengthwise along it, by which the magnetically chargeable dispensing roller 1 can be magnetically pressed against cylinder 2 and thus against the foil 6 being pushed through between dispensing roller 1 and cylinder 2.

Cylinder 2 rotates on a machine frame not being depicted, while its spindles are held in rotation bearings stationary relative to the machine. By means of a rotating drive not being depicted, cylinder 2 can be started into a rotating motion in direction L.

The dispensing cylinder 1 is attached so it can rotate by means of casings 4, which are placed on the frontal end pieces, where each casing 4 is placed so it can move freely in vertical direction V, while it is permanently fastened perpendicular to the vertical lengthwise walls 34 of tub 3, so it cannot move. The casing 4 is held on a sliding recess 32 by means of a T-shaped piece 43, seen in the top view of FIG. 2, that is shaped appropriately and that extends in vertical direction V, onto front wall 30 of the dipping tub 3. The front wall 30 is placed so that it fits perfectly within the rectangular cross section of dipping tub 3, where it forms a packing wall 31 for substance 7. The front wall 30 is placed so it can move in the longitudinal direction of the device, as illustrated with the double arrow S in FIG. 2. It can be fixed in its position by means of the mounting device 33 attached to the dipping tub 3 depicted as dotted lines, for example, by means of a screw-clamp connection that grasps onto the longitudinal wall 34.

Each casing 4 is pushed so far onto the end of the dispensing roller that the roller front wall 12 on the gliding system touches plate surface 42, which is formed by the bottom surface of the connection recess 40 of casing 4. By means of casing 4, which can be moved in direction S and secured in the desired position, the position of the dispensing roller 1 within the dipping tub 3 can be precisely adjusted, while it is freely movable in direction V.

The casing 4 is made from a non-magnetizable material such as brass. The connector recess 40 of casing 4 includes the end of dispensing roller 1 with identical shape and cross section along the terminal side of the length of the roller section A, over the largest part of the circumference of the roller, where a fit is designed in such a way that dispensing roller 1 remains easily movable with the circumference gliding system in connector recess 40.

The cross section of the connector intake 40 is proportioned in such a way that about 4/5 of the circumference of dispensing roller 1 is covered. Accordingly, the connector recess 40 is open towards the top by about 1/5 of the circumference of the roller. Through this opening 48, the roller section A lays exposed upwards, that is, toward the counter cylinder 2. The length of the lengthwise opening 48 corresponds to the length A of the covered longitudinal section of the roller.

The dispensing surface structure 11 of dispensing roller 1 is, for example, constructed by a conventional wire coil. It is essential in the design example that the dispensing roller 1 reach into the connector intake 40 with a section of its surface structure 11. In the design example, the length of intrusion B of this section, as can be observed in FIG. 2, represents about half of the length of intrusion A. Alongside the length B of the structure area the dispensing roller 1 is attached in a gliding-rotating system on the inside wall of the connector intake 40, so it can rotate without obstruction. It was found that this setting of the dispensing roller structure surface 11, in combination with the formation of the longitudinal opening 48 of the casing 4, leads to the production of a bulge free run-off edge, which is marked as such and whose width is indicated with R in the following (FIG. 2). In the framework of the invention, it is, however, also possible to use non-structured application rollers with totally smooth surfaces. For example, the application roller can be covered with an elastic layer or gummed.

From FIG. 1, which depicts the partial section view according to I—I in FIG. 2, the device can be seen in operational condition with a magnetically pressed dispensing roller 1, which means that it is drawn against the stationary cylinder system 2 by means of the magnetic device 5. The powered cylinder 2 revolves in direction L. The unpowered dispenser roller 1 in the design example revolves in the opposite direction D. A substrate to be layered with liquid (application substance) 7, namely the foil 6, lays adjacent to the area of dipping tub 3 on cylinder 2 and is pushed through the pressing zone between cylinder 2 and dispensing roller 1 in the movement direction L. The dispensing roller 1 dips, with its lower encasement, into the substance 7 that is held in the dipping tub 3, where a dispensing layer is pushed up over the rotating dispensing roller 1, between the fill gage and the roller vertex, in the direction of rotation D of the roller. A substance-drawing gusset 21 develops in front of the press line of the cylinder vertex in either rotating direction L or D.

The front area of casing 4 that faces dispensing roller 1 is flat and is perpendicular to the dispensing roller axis 10. The casing front is seen in either movement direction L or D, equipped with a wall section placed in front of the highest pressing point, which forms a front border wall 41 that features a handle section 411, that, when seen in profile cross section, has essentially the same shape as the drawing gusset 21. Here, the surface of front border wall 41, when seen in profile cross section of FIG. 1, is arched in a concave way and in such a way that there remains an insignificant gap 410 between the application surface (foil 6) and the concave area. This can actually be very small, for example a gap width of some 0.5 mm between the foil 6 and the front border wall 41. It has turned out to be particularly effective that the gap width in the run-off area, that is in the vertex area of roller 1, is larger than in the area in front of it. The gap width of the run-off area is particularly effective at 0.5 to 3 mm. In order to increase the width of the gap at its discharge point, the handle 411 of front wall 41 that holds the gusset area is outfitted with a beveled edge or bevel 49.

Seen from the rotating direction D of dispensing roller 1, the casing 4 in the area behind the place of application shows a lengthwise area 45 oriented against the rotating direction D of the roller, whose tangent adjoins the dispensing roller 1. For certain substances, this may facilitate a run-off of excess liquid.

As a result of the free cross section space created by gap 410, the pressure build-up in the area of the drawing gusset 21 can cause a low cross flow of substance, which, in a dynamic operational state, brings about a lengthwise liquid intake, that is, a flow in a parallel direction to the axis of roller 10 into section A. It has been shown that this generates a defined run-off edge R with a defined width during the coating of foil 6, specifically in the area B of the structure surface 11 of the dispensing roller 1 that is surrounded by casing 4. The application/coating thickness of run-off edge R is so low that the quality of the coating edge is satisfactory in every sense. It is essential that the usual pasty bulge on the edge of an application be reliably avoided and that a precise and cleanly defined coating area is achieved. This is of particular significance where a cleanly demarcated, at most very narrow, layering-free edge, indicated with Z in FIG. 2, needs to be produced between the coating layer applied on foil 6 and the edge of the foil.

By means of the previously described sliding placement between casing 4 and the tub-front 30, casing 4 is movable only transitorily in sliding direction V, while it is set so it cannot rotate on its lengthwise axis, as it is non-rotationally configured. As a result of connector intake 40 which covers the largest circumference portion of the dispensing roller, casing 4 is also permanently connected to dispensing roller 1. These measures allow casing 4 to be adjusted with the roller ends and transitorily pushed up through the magnetic attraction of the dispensing roller 1. This creates the defined gap 410 between the foil 6 and the gap area 46 in the pressing and operations mode of the device. By deactivating the magnetic beam 5, the dispensing roller tears away from the pressing point, and the configuration made up by the dispensing roller 1 and the casing 4 attached to it falls down into tub 3. Here casing 4 comes to rest on the bottom of the tub so that it builds an absorption stand for dispensing roller 1, which is particularly useful when the machine is being set up. Aside from this, the sliding connection between the casing 4 and the front wall 30 is also effectively implemented as a plug-in connection in the sliding direction, so that the configuration made up by the dispensing roller 1, the casing 4, the front walls 30 and the dipping tub 3 can be assembled or disassembled quickly and conveniently, for example to accommodate different dispensing rollers, that is, those of different lengths and/or different dispenser surface structures.

Figure 3:
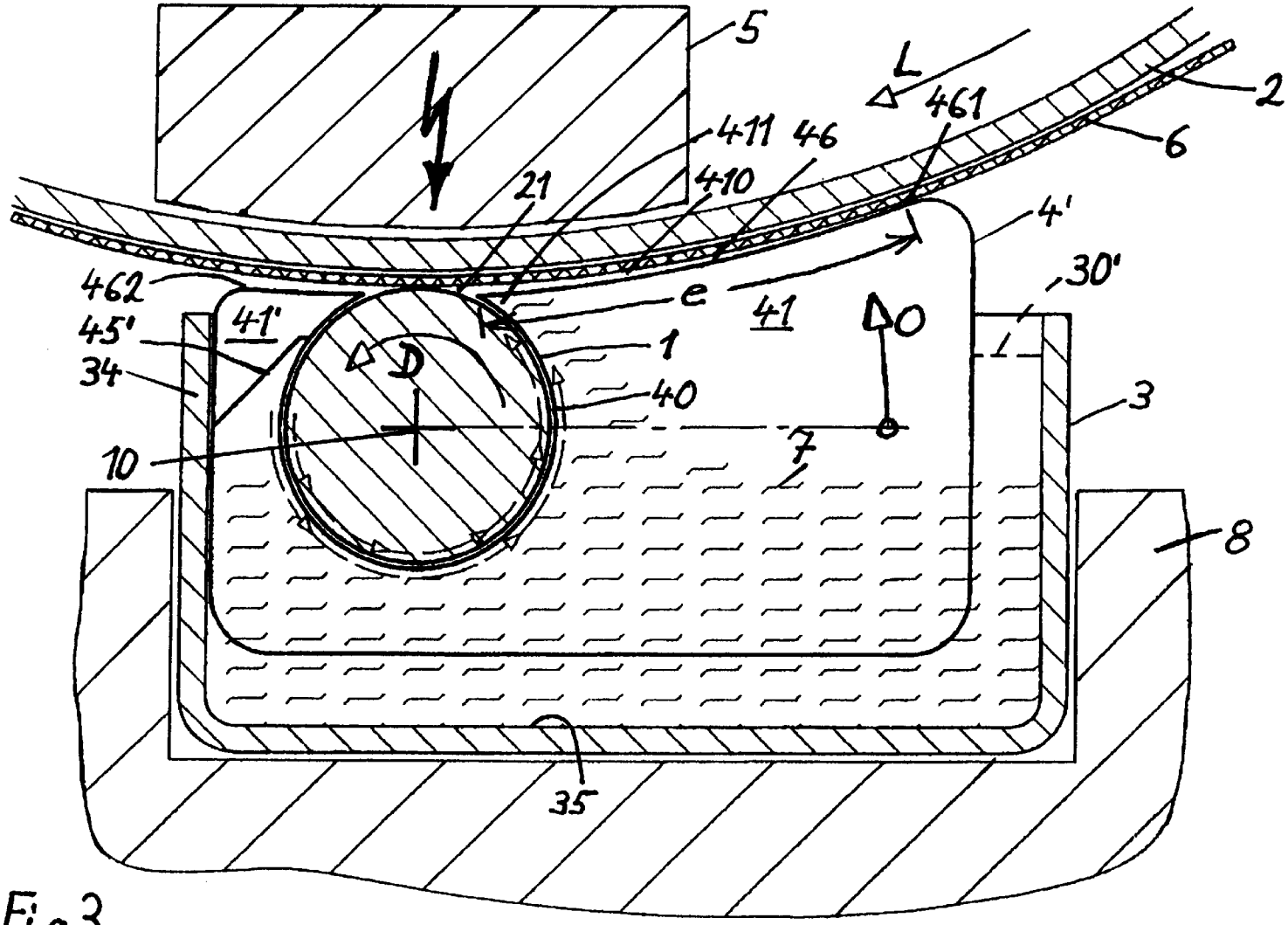
FIGS. 3 & 4 shows a partial profile section of another device according to the invention and shows a unit with a magnetic press and a dipping tub placed totally underneath a counter cylinder system.
Figure 4:
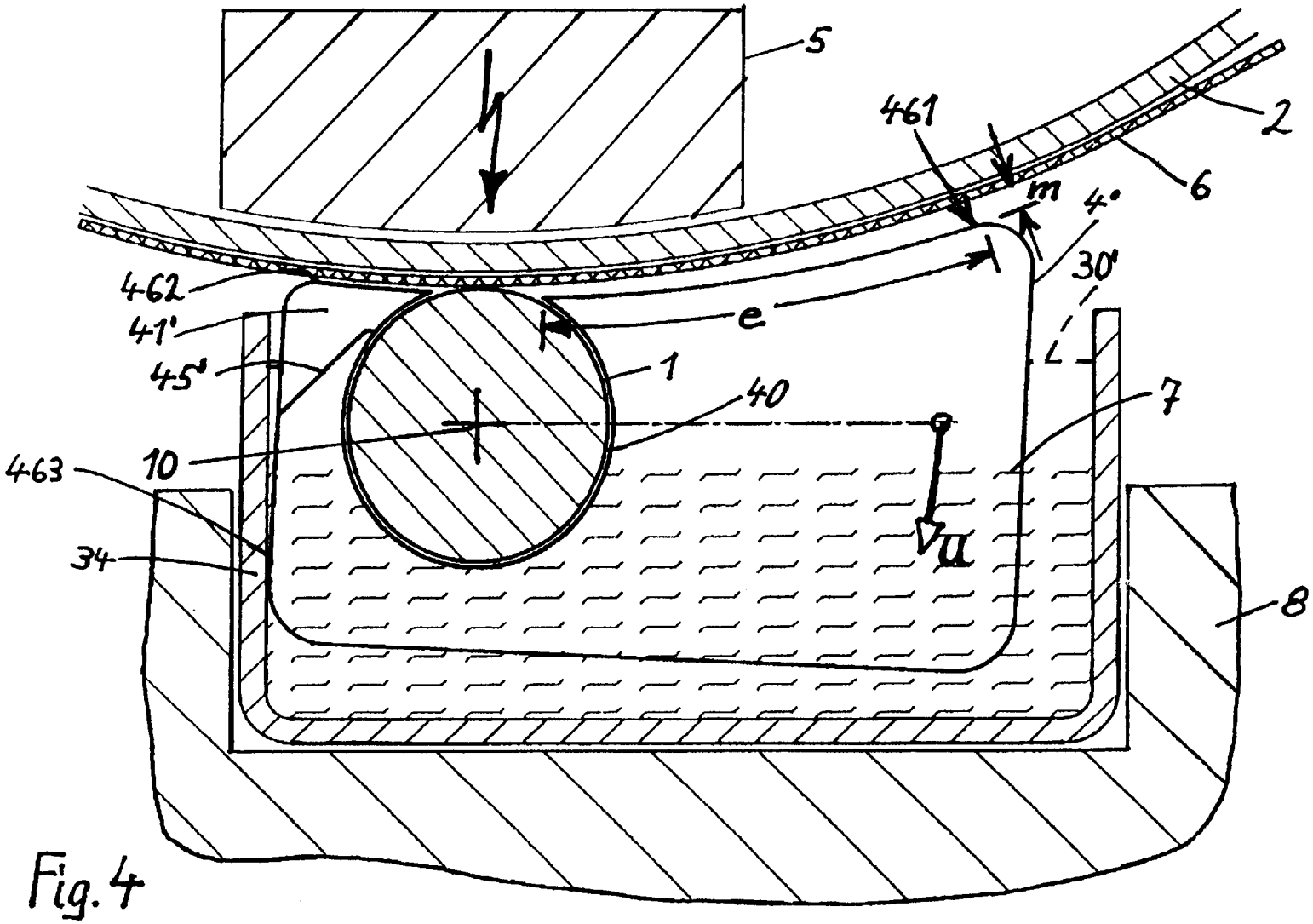

A design example in accordance with FIGS. 3 and 4 shows two casings 4' with changed placement. Otherwise, the device complies with the design example in accordance with FIGS. 1 and 2, where the same keying system is being used for the appropriate parts and configurations. The dipping tub 3 is placed in the corresponding placement recess of the device's mounting unit 8.

In FIGS. 3 and 4, each of the two casings 4' pushed onto on the front of dispensing roller 1, which swivel at least marginally on axis 10 of dispensing roller 1, is permanently attached by means of the latter. Viewed from the direction of movement L of the foil 6 (substrate), each casing 4' has a gap area 46 in the area in front of dispensing roller 1, whose span e between the dispensing roller 1 and a frontal, flat section of the system 461, which reaches up to against foil 6, is considerably larger than, for example about triple, the radius of dispensing roller 1.

The casing 4' extends also considerably longer than length e, for example, about 3.5 times the gap created with a casing wall 41' behind dispensing roller 1, when seen from the direction of movement L of the foil 6. That way, connector intake 40 of casing 4' is configured on the outside of the middle. In contrast to the design example according to FIGS. 1 and 2, each casing 4' is placed so that it swivels on the axis of the dispensing roller 1 such that, when seen from the direction of movement L of the foil 6, the casing piece that spans the front of dispensing roller 1 can reach a tipped position as shown in FIG. 4 from its original placement as depicted in FIG. 3.

One achieves the placement according to FIG. 3 during the working operation of the device, that is, through pressing dispenser roller 1 and counter cylinder 2 that rotates in direction L and, accordingly, the dispensing cylinder 1 which rotates in direction D. In a starting position which is not depicted, casings 4 are on the bottom 35 of dipping tub 3. By activating the magnetic beam 5, the magnetizable dispensing roller 1 is pressed against the foil 6, which also lifts both casings 4' made of non-magnetizable material, that hang from the dispensing roller, together with the former. The position depicted in FIG. 3 shows the possible final position, in which each casing 4', with the piece that spans the front of dispensing roller 1, swivels up in the direction O through the rotating motion of dispensing roller 1, until the system front section 461 of the gap area 46 touches foil 6. The total gap area of the casing 4' facing the foil 6 or the system cylinder 2 has a concave cross section and fits into the convex circular shape of counter system cylinder 2. A positive surface contact can be created with foil 6 on system section 461. The application substance 7 can act as a lubricant, depending on its composition. In the working position shown in FIG. 3, seen in the direction of movement L, the rear vertical edge of each casing 4' touches the longitudinal wall 34 of dipping tub 3.

Accordingly, as shown in the design example according to FIGS. 1 and 2, each casing 4' is provided with a longitudinal area 45', which is designed for the area behind dispensing roller 1 and which has an orientation directed against the direction of rotation D, so that, should the need arise, it can cause a run-off of an excess of substance 7 from the dispensing roller 1.

The tipped position shown in FIG. 4 is determined through the condition that both the counter cylinder 2 and dispensing roller 1 are stopped while dispensing roller 1 is being pressed magnetically against foil 6, or counter cylinder 2, by means of magnetic beam 5. In this position, the portion of casing 4' that spans the front of dispensing roller 1 swivels downwards in direction U, as a result of the effects of gravity on the portion of casing 4' that spans the front of the dispensing roller. The magnetically attracted dispensing roller 1 is offset marginally against the direction of movement L in the magnetic field by this swiveling motion. The casing 4' touches foil 6 on the edge of the gap behind dispensing roller 1 with the flat system element 462 and/or it touches longitudinal wall 34 of dipping tub 3 in the lower posterior area of vertical edge 463 against the tipping system. Consequently, the tipped position is limited, where the swivel motion in the area of the frontal system section 461 remains limited to the distance m, which is relatively small in comparison to the span length e.

The measures of the other design examples in accordance with FIGS. 3 and 4 preclude the possibility of a swiveling motion of the casings 4' around the dispensing roller axis 10 set in dipping tub 3, so that they practically cannot become wedged on their intake side area, that is, on the frontal section 461. This reliably precludes the dispenser roller or application roller 1 from pushing away partially or totally from its working position.

In a design concept in accordance with FIG. 3, each casing 4' can also be configured to be movable along the length of the device. Instead of the sliding bearing described in FIG. 2, a portion of casing 4' which corresponds to bearing 43 shown in FIG. 2 can be held with three degrees of freedom by means of a recess, not depicted, belonging to front cross wall 30'.

What is claimed is:

1. A device for application of viscous liquids onto a movable substrate, comprising:

an application roller that spans a length of the device;

a supply mechanism that provides viscous liquid to the application roller;

a pressing device that pushes the application roller against the movable substrate to create a narrowing intake gusset in the direction of movement of the application roller; and at least one demarcation element that, in combination with the application roller, defines a width of application of the viscous liquid being applied to the movable substrate;

wherein the demarcation element includes a casing that covers the application roller along a section of the length of the application roller and over a portion of a circumference of the application roller, and wherein a part of the section of the length of the application roller forms a segment that is transverse to the direction of movement of the movable substrate for causing a liquid intake in said transverse direction.

2. A device according to claim 1, wherein the casing includes a frontal wall that, in profile cross section, covers an area of the intake gusset created between the application roller and the movable substrate.

3. A device according to claim 1, wherein the application roller is a dispensing roller with a dispensing area that juts into the casing in the longitudinal direction of the application roller by a predetermined length.

4. A device according to claim 1, wherein said casing covers said section of the length of the application roller so as to be open only where the application roller section contacts the moving substrate.

5. A device according to claim 1, wherein the casing, as viewed in a rotating direction of the application roller, has a longitudinal area with an orientation that is directed against the rotation direction of the application roller and that juts into an area of a circumference of the application roller onto the substrate.

6. A device according to claim 1, wherein the application roller has a dispensing surface structure of at least one of a wire coil and a threaded structure.

7. A device according to claim 1, wherein the casing is adjustable in the longitudinal direction of the device.

8. A device according to claim 1, further including two casings, between which is defined the width of the application of the viscous liquid being applied to the movable substrate.

9. A device according to claim 1, wherein the casing includes a gap area in front of the application roller having a span length transverse to an axis of the application roller that is larger than a radius of the application roller.

10. A device according to claim 1, wherein the casing is positioned onto the application roller, and is movable transverse to the surface of the substrate.

11. A device according to claim 1, including a casing that is moved by a sliding bearing in a direction in which the application roller presses.

12. A device according to claim 1, wherein the casing, as seen in the direction of movement of the movable substrate, swivels on the axis of the application roller, and further wherein the casing has a front system element that touches the substrate at a distance from the application roller.

13. A device according to claim 1, wherein an intake gap is formed in front of the application roller between the casing and the movable substrate that extends further than an output gap behind the application roller formed between the casing and the substrate.

14. A device according to claim 1, wherein said pressing device is a magnetic press mechanism and the movable substrate is moved across a magnetic device, and further wherein the application roller is magnetizable so that the application roller presses magnetically against the movable substrate.

15. A device according to claim 1, wherein the application roller is positioned inside a dipping tub that supplies a source of the viscous liquid at an orientation vertically beneath the application roller.

16. A device according to claim 1, further including a counter cylinder as a roller cylinder which moves the movable substrate past the application roller.

17. A device according to claim 12, wherein the casing has a vertical edge in the area behind the application roller when viewed in the direction of movement of the substrate, which vertical edge is arranged to press against an impact element so as to limit the swivel range of the casing on the application roller axis when the application roller is not rotating while the application roller presses against the substrate.

* * * * *